US010544622B2

(12) United States Patent
Hebeisen et al.

(10) Patent No.: US 10,544,622 B2
(45) Date of Patent: Jan. 28, 2020

(54) WIRED POCKET

(71) Applicant: MechoShade Systems, Inc., Long Island City, NY (US)

(72) Inventors: Stephen P. Hebeisen, Amawalk, NY (US); Xi Ming Liarno, Brooklyn, NY (US); Eugene Miroshnichenko, Oceanside, NY (US); John Wilk, Staten Island, NY (US)

(73) Assignee: MECHOSHADE SYSTEMS, INC., Long Island City, NJ (US)

( * ) Notice: Subject to any disclaimer, the term of this patent is extended or adjusted under 35 U.S.C. 154(b) by 137 days.

(21) Appl. No.: 15/334,591

(22) Filed: Oct. 26, 2016

(65) Prior Publication Data

US 2017/0114593 A1 Apr. 27, 2017

Related U.S. Application Data

(60) Provisional application No. 62/247,036, filed on Oct. 27, 2015.

(51) Int. Cl.
*E06B 9/17* (2006.01)
*E06B 9/42* (2006.01)

(52) U.S. Cl.
CPC ..... *E06B 9/42* (2013.01); *E06B 9/17007* (2013.01)

(58) Field of Classification Search
CPC ..... E06B 9/17; E06B 9/174; E06B 9/17007; E06B 9/17015; E06B 9/170023; A47H 1/13; A47H 1/19

(Continued)

(56) References Cited

U.S. PATENT DOCUMENTS 3,007,036 A * 10/1961 Mills, Jr. ..... F21V 17/104 160/38
4,060,310 A * 11/1977 Brown ..... G03B 21/58 160/310

(Continued)

FOREIGN PATENT DOCUMENTS

AT 399200 B * 3/1995
DE 3806611 A1 * 9/1989

(Continued)

OTHER PUBLICATIONS

Office Action dated Aug. 30, 2017 in Canadian Application No. 2,946,634.

(Continued)

*Primary Examiner* — Robert Canfield
(74) *Attorney, Agent, or Firm* — Snell & Wilmer L.L.P.

(57) ABSTRACT

A window shade pocket system comprises a pocket having an inside surface, a bracket removably affixed to the inside surface of the pocket and a roller shade within the pocket. The bracket may retain cabling and/or electrical components within the bracket. The bracket may include a plurality of brackets along the inside surface of the pocket, wherein the cabling is retained within the plurality of brackets. The brackets may form a channel between the bracket and the inside surface of the pocket. The roller shade may be able to be removed after the bracket is removed. The pocket may also be comprised of a first component having a first engagement device and a second component having a second engagement device, wherein the first engagement device engages the second engagement device to form the pocket.

20 Claims, 7 Drawing Sheets

(58) Field of Classification Search
USPC ..... 160/23.1, 323.1, 38, 310; 359/461
See application file for complete search history.

(56) References Cited

U.S. PATENT DOCUMENTS

| | | | | |
|---|---|---|---|---|
| 4,156,270 | A * | 5/1979 | Beatty | F21V 17/04 362/145 |
| 4,169,658 | A * | 10/1979 | Brown | G03B 21/58 352/36 |
| 4,254,813 | A * | 3/1981 | Vecchiarelli | A47H 2/00 160/19 |
| 4,404,770 | A * | 9/1983 | Markus | E05D 15/1021 49/235 |
| 4,753,025 | A * | 6/1988 | Wennstrom | G09F 11/025 40/470 |
| 5,046,380 | A * | 9/1991 | Matsumoto | F16C 1/105 74/502.4 |
| 5,067,540 | A * | 11/1991 | Besler | E06B 9/17023 160/23.1 |
| 5,121,782 | A * | 6/1992 | Renkhoff | E04F 10/0618 160/22 |
| 5,296,964 | A * | 3/1994 | Shopp | G03B 21/58 160/19 |
| 6,111,694 | A * | 8/2000 | Shopp | G03B 21/58 160/23.1 |
| 6,230,782 | B1 * | 5/2001 | Reichert | E06B 9/17023 160/23.1 |
| 6,253,492 | B1 * | 7/2001 | Finke | E05D 1/06 16/87.4 R |
| 6,410,908 | B1 | 6/2002 | Anderson et al. | |
| 6,421,175 | B1 | 7/2002 | Shopp | |
| 6,446,394 | B1 * | 9/2002 | Finke | E05D 15/0652 49/409 |
| 6,532,109 | B1 * | 3/2003 | Shopp | G03B 21/58 160/23.1 |
| 6,736,186 | B2 | 5/2004 | Anderson | |
| 6,816,308 | B1 * | 11/2004 | Shopp | G03B 21/58 160/23.1 |
| 6,873,461 | B1 | 3/2005 | McPherson, Jr. | |
| 7,559,707 | B2 | 7/2009 | Shopp | |
| 9,115,537 | B2 | 8/2015 | Blair | |
| 2005/0205216 | A1 * | 9/2005 | Vrielink | E06B 9/323 160/23.1 |
| 2013/0068398 | A1 | 3/2013 | Wills | |
| 2017/0114593 | A1 | 7/2017 | Hebeisen et al. | |
| 2018/0106102 | A1 | 4/2018 | Holt et al. | |
| 2018/0163465 | A1 | 6/2018 | Biedermann | |

FOREIGN PATENT DOCUMENTS

| | | | |
|---|---|---|---|
| EP | 2631415 | A2 * | 8/2013 |
| EP | 2843178 | B1 * | 12/2016 |
| FR | 2911364 | A1 * | 7/2008 |
| GB | 2542330 | A * | 3/2017 |
| JP | 2000192757 | | 7/2000 |
| JP | 2003221987 | | 8/2003 |
| JP | 2004076300 | | 3/2004 |
| JP | 2014214524 | | 1/2010 |
| JP | 2013108238 | | 6/2013 |
| JP | 2013170441 | | 9/2013 |
| JP | 2014234593 | | 12/2014 |

OTHER PUBLICATIONS

Combined Search and Examination Report dated Mar. 9, 2017 in GB Application No. GB1618179.4.

Examination Report dated Jul. 6, 2017 in GB Application No. GB1618179.4.

Notice of Allowance dated Jan. 4, 2018 in Canadian Application No. 2,946,634.

* cited by examiner

WIRED POCKET

CROSS-REFERENCE TO RELATED APPLICATIONS

This disclosure claims priority to, and the benefit of, U.S. Provisional Application Ser. No. 62/247,036 filed on Oct. 27, 2015 and entitled "Wired Pocket", which is hereby incorporated by reference in its entirety.

FIELD

The disclosure relates to window shade systems, and more particularly, to pockets for mounting the brackets and roller.

BACKGROUND

Window shade systems typically include a pocket (or space) for mounting the shade and another pocket for housing the wiring associated with the shade and other electronics. The window shade installer must often determine where to locate each of the pockets. The locations of the pockets may be important for not only accessibility, but also to comply with certain fire codes. An important part of the decision for the pocket location is the different codes that may apply to different areas. For example, items that exist in a room may be subject to different fire codes than items that exist in the ceiling or plenum. Such codes may determine if the contractor needs to include plenum cable or non-plenum cable. The type of jacket surrounding the cable may be impacted by the location of the cable.

The plenum spaces are between a drop and standard ceiling. The plenum spaces may also similarly exist in the floor space. These spaces are where the air in a building circulates, so these spaces are used to aid in heating and cooling functions. While non-plenum (PVC) cable is less expensive, plenum cable is often required when no conduit is used in the plenum spaces. Fire and smoke travel quickly in plenum spaces. As such, the levels of toxicity in the smoke are typically lower since plenum cable includes a jacket that is often comprised of flame-resistant material (e.g., Teflon). The flame resistant material results in the cable smoking less than regular non-plenum (PVC) cable and the smoke that is emitted is less toxic. If the window shade pocket can be considered to be part of the room (and not part of the plenum), then the less expensive non-plenum cabling can be used in the pocket.

Moreover, a pocket that holds a window shade may be a very long structure. Because different pockets may need to accommodate different size shades, the pockets may vary in size. Furthermore, the pockets may include different features which may need to be incorporated into the pocket walls. The design of a pocket should take into consideration all of these features, while still being designed to be as light and inexpensive as possible.

SUMMARY

The disclosure includes a window shade pocket system comprising a pocket having an inside surface, a bracket removably affixed to the inside surface of the pocket and a roller shade within the pocket. The inside surface of the pocket may include a first wall, a second wall and a third wall, wherein the third wall includes the bracket retaining the cabling. The bracket may retain cabling and/or electrical components within the bracket. The bracket may include a plurality of brackets along the inside surface of the pocket, wherein the cabling is retained within the plurality of brackets. The brackets may form a channel between the bracket and the inside surface of the pocket. The roller shade may be able to be removed after the bracket is removed or the roller shade may be able to be removed while the bracket is still affixed to the inside surface of the pocket.

The bracket may include a bent metal retaining clip or a spring clip. The end of the bracket may be retained behind a lip extruding from a ledge. The end of the bracket may be bent into an arc, wherein the arc is retained behind a lip extruding from a ledge. The bracket may include a planar metal plate having a top edge and a bottom edge, wherein the top edge is retained in a first channel and the bottom edge is retained in a second channel.

The pocket may be comprised of a first component having a first engagement device and a second component having a second engagement device, wherein the first engagement device engages the second engagement device to form the pocket. The disassembled pocket may also be comprised of a first component nested into a second component to reduce space for shipping. The pocket may be comprised of a first component and a replaceable second component, wherein the second component may be replaced with a third component that results in a different width of the pocket. Moreover, the second component having a second bracket may be replaced with a third component having a third bracket.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

As set forth in more detail in the attached drawings, the present disclosure includes cabling and other components 110 (e.g., power plug, splitter, electrical components, etc) in the window shade pocket 100. The window shade pocket 100 may be outside of the plenum and considered part of the room, and not part of the ceiling. However, the window shade pocket 100 may be in the plenum, but the pocket 100 may still be considered part of the room. By including the cabling and other components in the window shade pocket 100, the cabling may not need to meet the more restrictive and more expensive ceiling fire codes. As such, the less expensive non-plenum (e.g., PVC) cabling may be used in the pocket 100.

In various embodiments, the cabling and other components 110 may be incorporated into the window shade pocket 100 in any manner. In this manner, the pocket 100 combines the functionality of a mounting space (e.g., for roller shades) and wiring space. In various embodiments, the window shade pocket 100 may include one or more permanent or removable channel that retains the cables and/or other components 110. In various embodiments, the pocket 100 and/or brackets 105 may be comprised of aluminum or non-metallic material. In various embodiments, the pocket 100 and/or brackets 105 may also be modular to support various ceiling systems and attachments. In various embodiments, the brackets 105 may be continuous down all or a portion of the pocket 100 (as set forth in FIG. 6) or may be spaced periodically along the inside of the pocket 100 (as set forth in FIG. 7).

Figure 6:
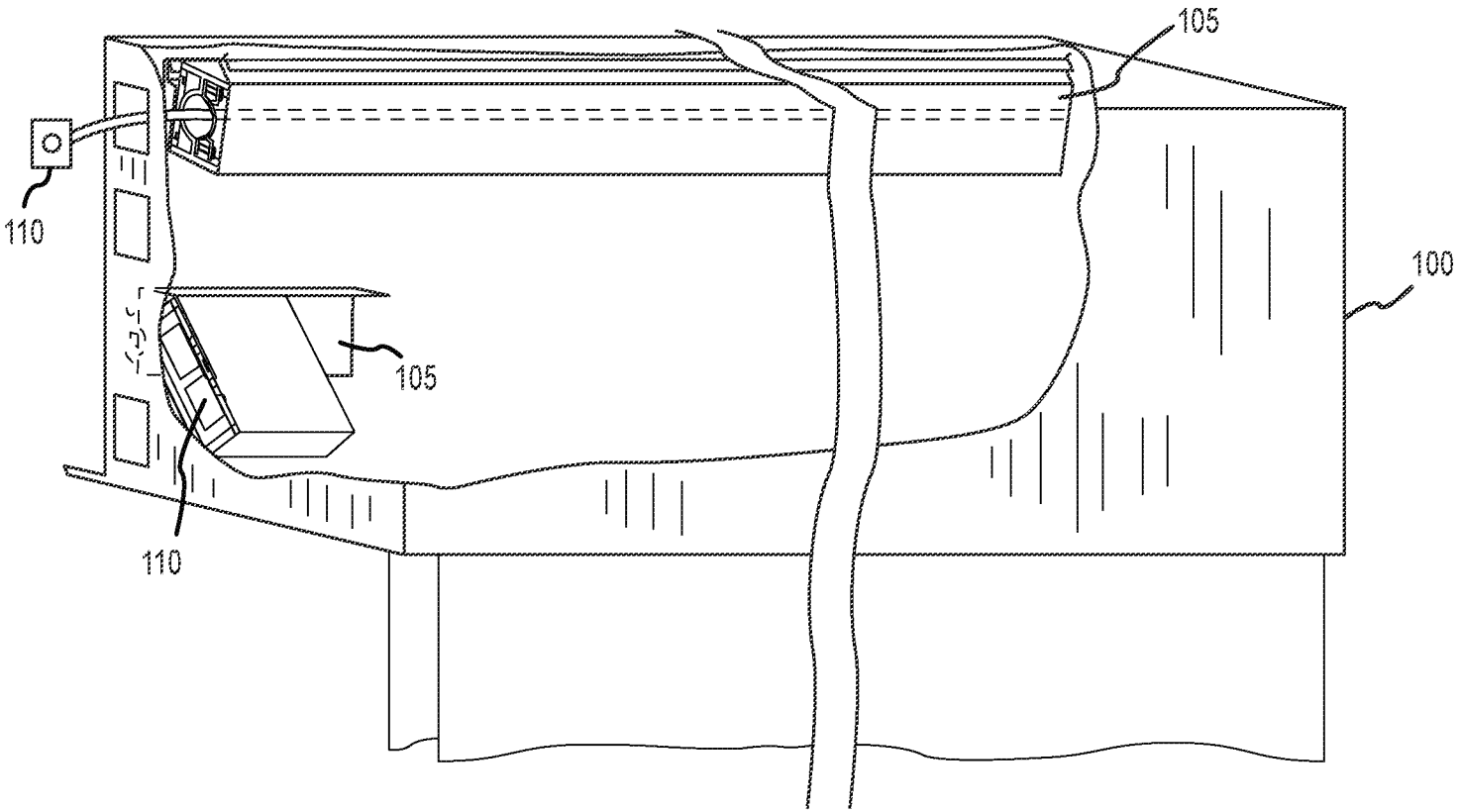
FIG. 6 is an exemplary diagram of a cut-away view of a window shade pocket showing a full first bracket, a second bracket and cabling, in accordance with various embodiments.
Figure 7:
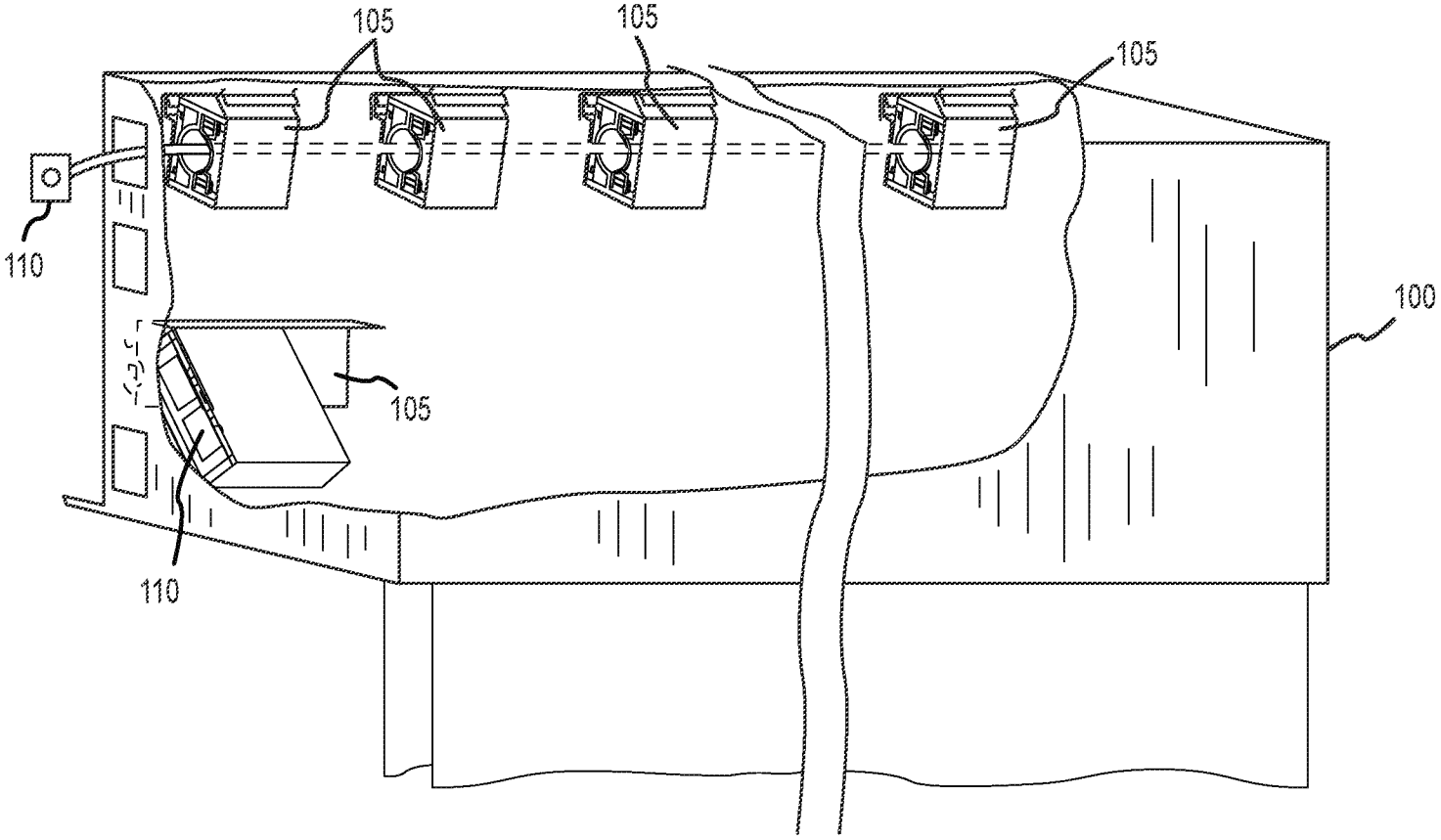
FIG. 7 is an exemplary diagram of a cut-away view of a window shade pocket showing a plurality of first brackets, a second bracket and cabling, in accordance with various embodiments.

In various embodiments, and as set forth in FIGS. 6-7, the cables may be held in the channels directly. Hooks, retaining clips and/or springs may allow access to the cabling. Clip-in-brackets 105 may be included to reduce weight and to reduce the cost of pocket 100. The clip-in-brackets 105 may be the entire length of the pocket 100, over a portion of the pocket 100 and/or multiple brackets 105 over specified separation mounting distances. The brackets 105 may mount on one or more of the faces of the pocket 100. The shade 115 may be removed (or more easily removed) after the retaining clip or channel is removed. The shade may also be removed around the bracket, while the bracket 105 is still installed.

The brackets 105 may be mounted to allow the roller shade to operate without impacting the bracket. The cabling may be serviced while protecting the cables from physical access or exposure to the rotating shade 115. In various embodiments, additional safety features may be incorporated into the system such as, for example, methods of separation of high and low voltage cabling to meet code (e.g., distance versus metal barrier). In various embodiments, the pocket 100 may be grounded and/or a junction box may be included in the pocket 100. In various embodiments, the pocket 100 may include venting options such as, for example, pre-punched holes and/or a removable back wall where a punched sheet can be inserted. Such venting features can even be added after installation. The hole sizes may be variable. The pocket 100 and brackets 105 may include features to prevent or minimize vibration for various attachments.

More specifically, and in various embodiments, the window shade pocket 100 system may comprise a pocket 100 having an inside surface, a bracket 105 removably affixed to the inside surface of the pocket 100 and a roller shade 115 within the pocket 100. The inside surface of the pocket 100 may include a first wall 120, a second wall 125 and a third wall 130, wherein the third wall 130 includes the bracket 105 retaining the cabling. The bracket 105 may retain cabling and/or electrical components 110 within the bracket. The bracket 105 may include a plurality of brackets 105 along the inside surface of the pocket 100, wherein the cabling is retained within the plurality of brackets 105. The bracket 105 may form a channel between the bracket 105 and the inside surface of the pocket 100. The roller shade 115 may be able to be removed after the bracket 105 is removed or the roller shade 115 may be able to be removed while the bracket 105 is still affixed to the inside surface of the pocket 100.

Figure 1:
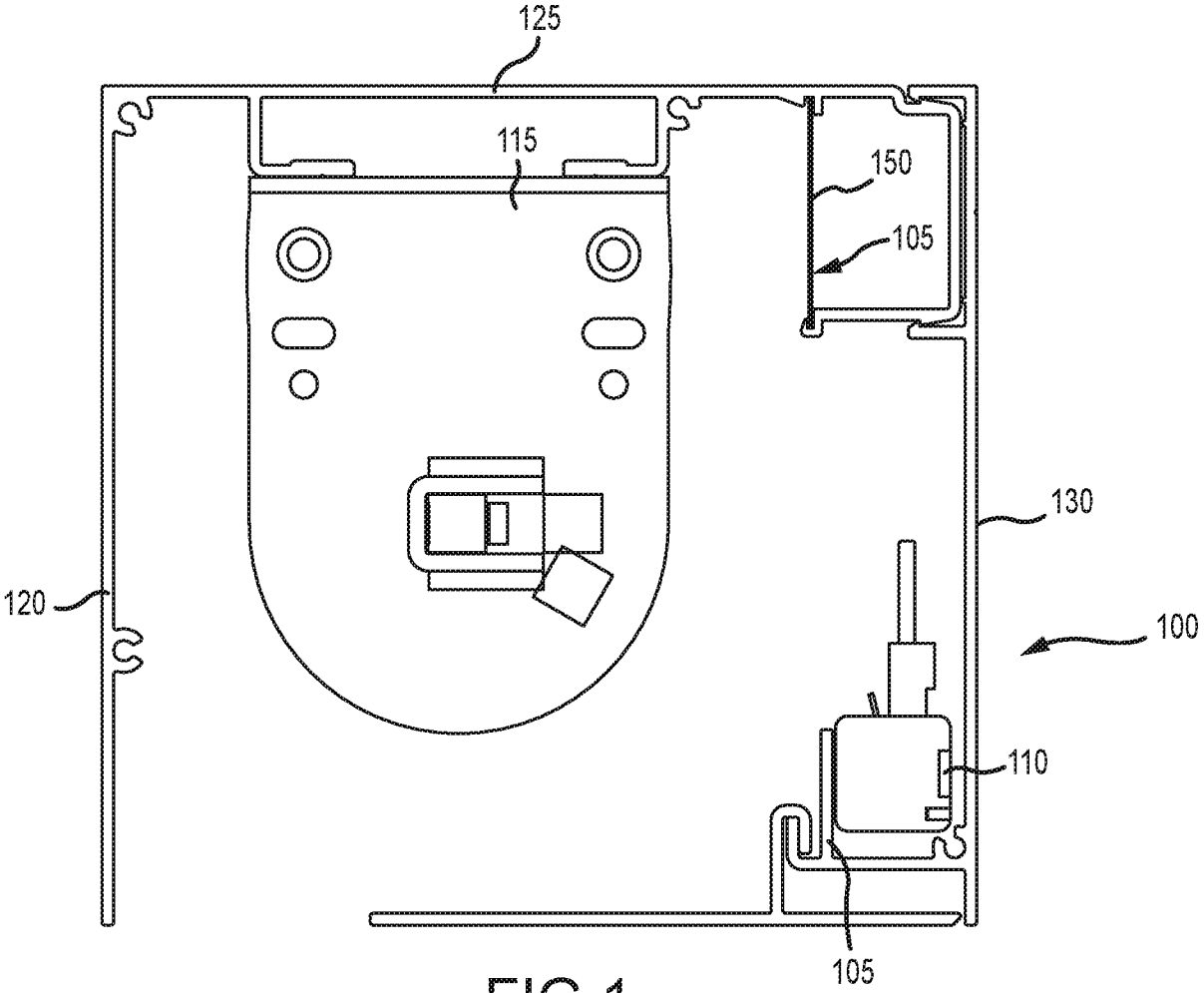
FIG. 1 is a schematic diagram of a window shade pocket with a roller shade and a planar bracket, in accordance with various embodiments.
Figure 2:
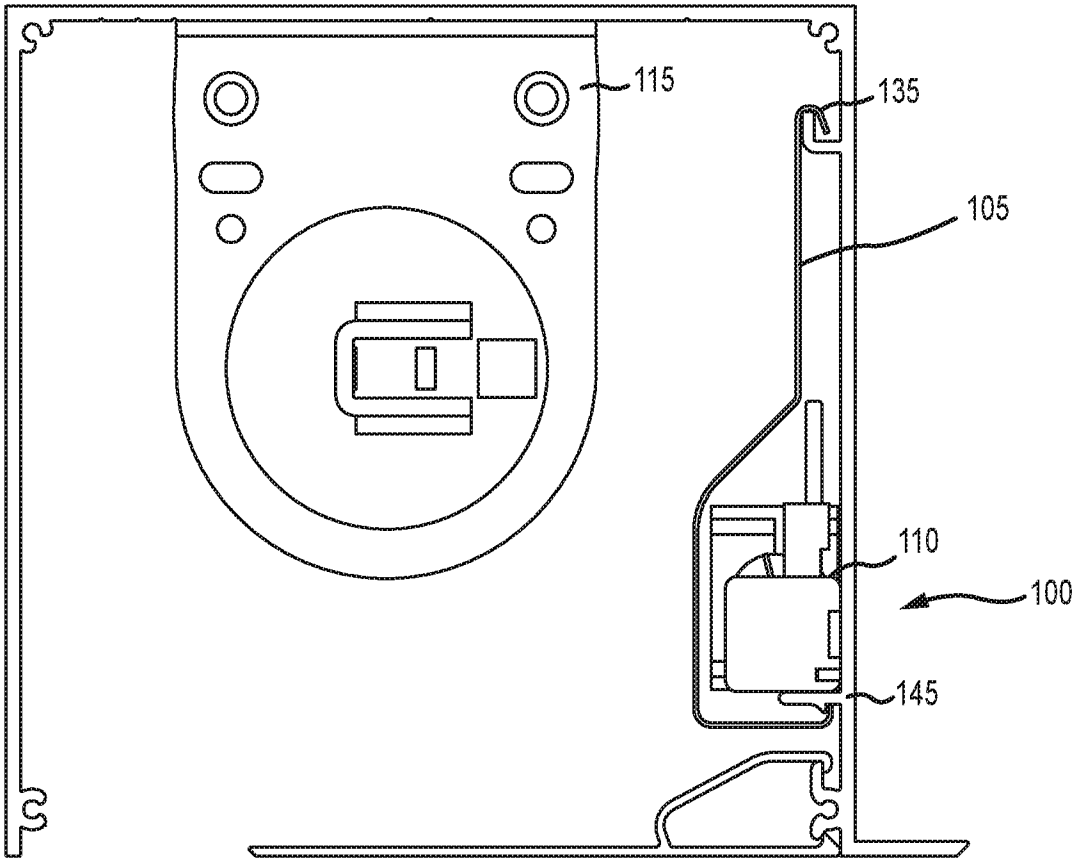
FIG. 2 is a schematic diagram of a window shade pocket with a roller shade and a bracket having a bent metal retaining clip, in accordance with various embodiments.
Figure 3:
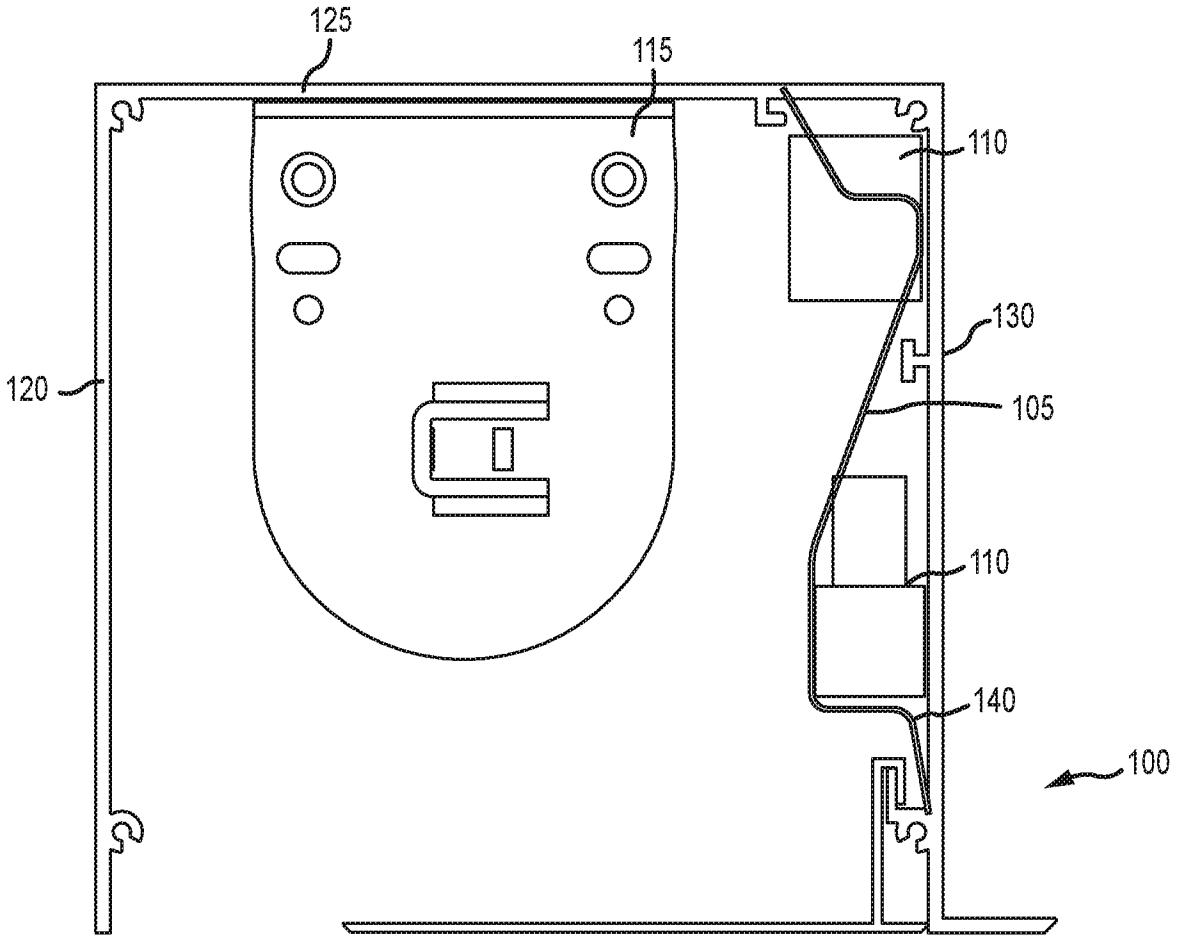
FIG. 3 is a schematic diagram of a window shade pocket with a roller shade and a bracket having a spring clip, in accordance with various embodiments.

In various embodiments, the bracket 105 may include a bent metal retaining clip 135 (as shown in FIG. 2) and/or a spring clip 140 (as shown in FIG. 3). The end of the bracket 105 may be retained behind a lip 145 (as shown in FIG. 2) extruding from a ledge. The end of the bracket 105 may be bent into an arc 135, wherein the arc is retained behind a lip extruding from a ledge. The bracket 105 may include a planar metal plate 150 (as shown in FIG. 1) having a top edge and a bottom edge, wherein the top edge is retained in a first channel and the bottom edge is retained in a second channel.

Figure 5:
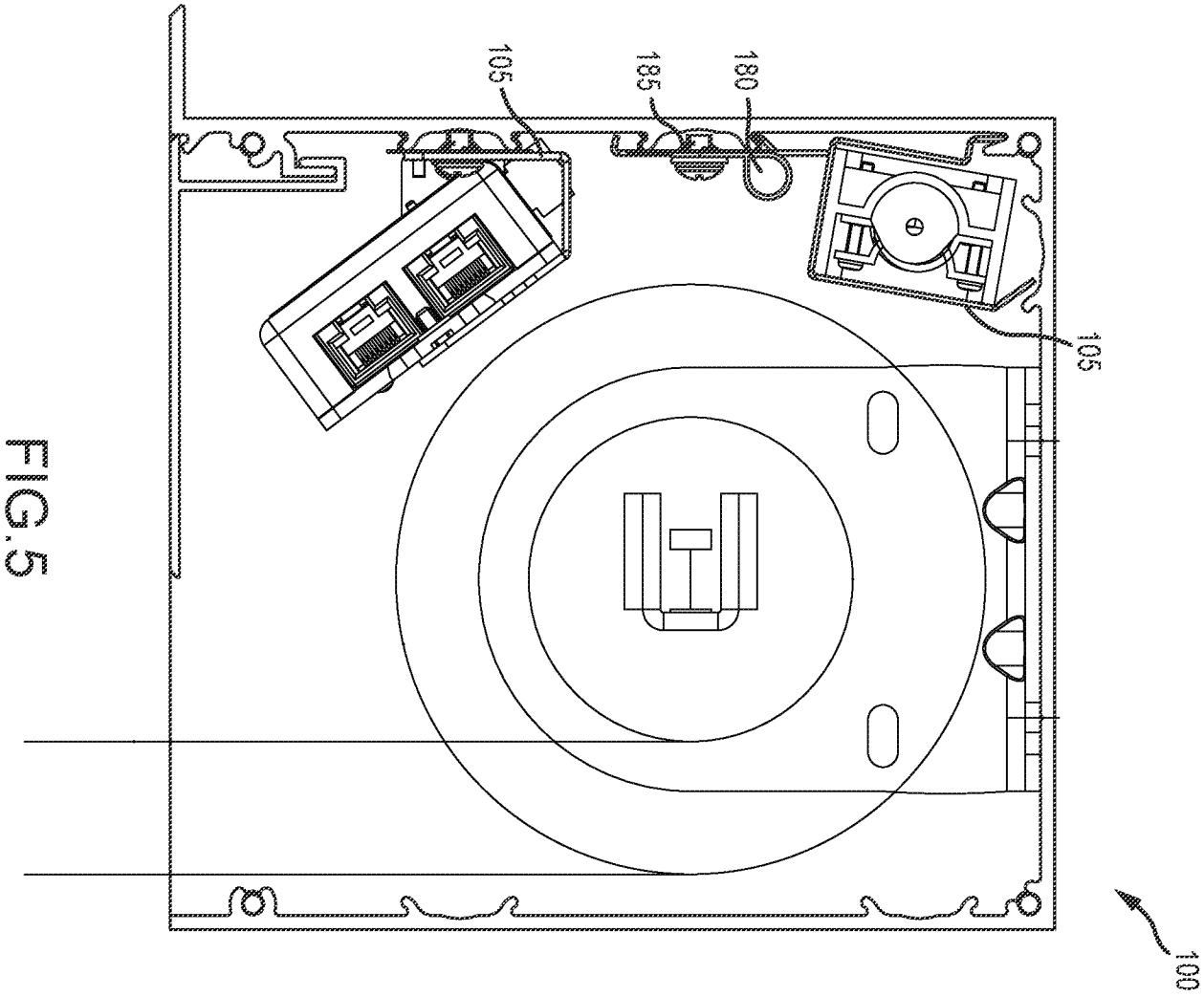
FIG. 5 is a schematic diagram of a window shade pocket with a roller shade and a additional bracket embodiments along with a cable clip, in accordance with various embodiments.

Additional bracket 105 embodiments are shown in FIG. 5 supporting different electronic components, but still avoiding contact with the roller shade. A cable clip 180 is also shown in FIG. 5. Cable clip 180 is configured to receive a cable and provide support for the cable, while keeping the cable close to the side wall of pocket 100. Cable clip 180 and/or bracket 105 may attach to the side wall of pocket 100 using, for example, miter angles 185. Miter angles 185 include curved ends that partially wrap around the lips protruding from the side wall. Upon tightening the fastener against the side wall, the curved ends tightly engage the lips protruding from the side wall, thereby securely fastening bracket 105 to the side wall of pocket 100.

Figure 4:
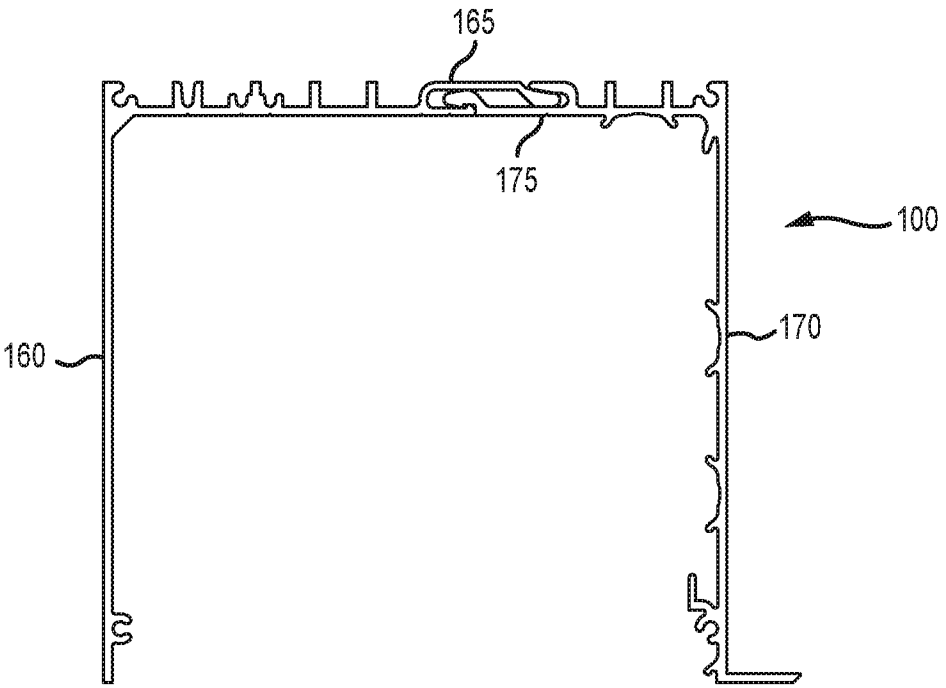
FIG. 4 is a schematic diagram of a window shade pocket showing the engagement device on the top wall, in accordance with various embodiments.

In various embodiments, and as shown in FIG. 4, the pocket 100 may be comprised of a first component 160 having a first engagement device 165 and a second component 170 having a second engagement device 175, wherein the first engagement device 165 engages the second engagement device 17 to form the pocket 100. Having the pocket 100 comprised of two components may allow for a smaller die to extrude the aluminum for each component. Moreover, having the pocket 100 comprised of two components provides the ability to have different widths assembled by only changing one of the components (extrusions). Having the pocket 100 comprised of two engaged components also provides the ability to have different features in the assembled pocket 100 by simply changing one of the extrusions. Furthermore, having the pocket 100 comprised of two engaged components also allows a design of the pocket 100 with thinner walls and thus makes the pocket 100 lighter and less expensive. However, having the pocket 100 comprised of two engaged components may not impact the brackets 105 and the electrical channels discussed herein because the engagement is on the top panel and not on the side panels where the brackets 105 may be inserted.

The disassembled pocket 100 may also be comprised of a first component 160 nested into a second component 170 to reduce space for shipping. The pocket 100 may be comprised of a first component and a replaceable second component, wherein the second component may be replaced with a third component (e.g., of a different size) that results in a different width of the pocket 100. Moreover, the second component 170 having a second bracket 105 may be replaced with a third component having a third bracket 105.

The detailed description of exemplary embodiments herein makes reference to the accompanying drawings, which show exemplary embodiments by way of illustration and its best mode, and not of limitation. While these exemplary embodiments are described in sufficient detail to enable those skilled in the art to practice the invention, it should be understood that other embodiments may be realized and that logical, chemical and mechanical changes may be made without departing from the spirit and scope of the invention. For example, the steps recited in any of the method or process descriptions may be executed in any order and are not necessarily limited to the order presented. Moreover, many of the functions or steps may be outsourced to or performed by one or more third parties. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Systems and methods are provided. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the invention. The scope of the invention is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention claimed is:

1. A window shade pocket system comprising:

a pocket having an inside surface, a first wall and a second wall, wherein a roller shade is mounted within the pocket, wherein the pocket includes a length extending from a first end of the pocket to a second end of the pocket;

a first bracket removably affixed to the inside surface of the first wall of the pocket;

a second bracket removably affixed to the inside surface of the second wall of the pocket;

wherein the first bracket extends along the length of the pocket from the first end of the pocket to the second end of the pocket, and wherein the first bracket retains non-plenum cabling, wherein the non-plenum cabling extends within the pocket;

the second bracket retaining an electrical component.

2. The window shade pocket system of claim 1, further comprising pre-punched holes in the second wall to allow the pocket to function as an air return and provide venting of air and cooling of the electrical component.

3. The window shade pocket system of claim 1, wherein the first bracket forms a channel between the first bracket and the inside surface of the pocket.

4. The window shade pocket system of claim 1, wherein the non-plenum cabling within the first bracket also exits from the first bracket to couple with the electrical component.

5. The window shade pocket system of claim 1, wherein the non-plenum cabling is comprised of PVC.

6. The window shade pocket system of claim 1, wherein the first bracket includes at least one of a cable clip, metal retaining clip with a bent end or a spring clip wherein an end of the spring clip is bent behind a lip.

7. The window shade pocket system of claim 1, wherein an end of the first bracket is retained behind a lip protruding from a ledge.

8. The window shade pocket system of claim 1, wherein an end of the first bracket is bent into an arc, wherein the arc is retained behind a lip extruding from a ledge.

9. The window shade pocket system of claim 1, wherein the first bracket includes a planar metal plate.

10. The window shade pocket system of claim 1, wherein the first bracket includes a planar metal plate having a top edge and a bottom edge, wherein the top edge is retained in a first channel and the bottom edge is retained in a second channel.

11. The window shade pocket system of claim 1, wherein the roller shade is able to be removed after the first bracket is removed.

12. The window shade pocket system of claim 1, wherein the roller shade is able to be removed while the first bracket is still affixed to the inside surface of the first wall of the pocket.

13. The window shade pocket system of claim 1, wherein the pocket is comprised of a first component and a second component.

14. The window shade pocket system of claim 1, wherein the pocket is comprised of a first component having a first engagement device and a second component having a second engagement device, wherein the first engagement device engages the second engagement device to form the pocket.

15. The window shade pocket system of claim 1, wherein upon disassembling the pocket, the pocket is comprised of a first component nested into a second component to reduce space for shipping.

16. The window shade pocket system of claim 1, wherein the pocket is comprised of a first component and a replaceable second component.

17. The window shade pocket system of claim 1, wherein the pocket is comprised of a first component and a second component, wherein the second component is replaced with a third component that results in a different width of the pocket.

18. The window shade pocket system of claim 1, wherein the pocket is comprised of a first component and a second component having a second bracket, wherein the second component is replaced with a third component having a third bracket.

19. The window shade pocket system of claim 1, wherein an end of the first bracket is retained behind a lip emanating from a ledge.

20. The window shade pocket system comprising:

a pocket having an inside surface, a first wall and a second wall, wherein a roller shade is mounted within the pocket, wherein the pocket includes a length extending from a first end of the pocket to a second end of the pocket;

a plurality of first brackets along the inside surface of the pocket and spaced along the length of the pocket from the first end of the pocket to the second end of the pocket;

the plurality of first brackets being removably affixed to the inside surface of the first wall of the pocket;

the plurality of first brackets retaining non-plenum cabling, wherein the non-plenum cabling extends-within the pocket;

a second bracket removably affixed to the inside surface of the second wall of the pocket; and the second bracket retaining an electrical component.

* * * * *